US008205933B2

(12) United States Patent
Boczek et al.

(10) Patent No.: US 8,205,933 B2
(45) Date of Patent: Jun. 26, 2012

(54) LETHAL THREAT PROTECTION SYSTEM FOR A VEHICLE AND METHOD

(75) Inventors: Michael S. Boczek, Burlington, KY (US); Todd A. Huffington, Fairfield, OH (US); Kevin M. Klatte, Milford, OH (US); Robert C. Martin, Milford, OH (US); Michael D. Reynolds, Jr., Cincinnati, OH (US); David J. Wolf, Cincinnati, OH (US)

(73) Assignee: BAE Systems Survivability Systems, LLC, Fairfield, OH (US)

( * ) Notice: Subject to any disclaimer, the term of this patent is extended or adjusted under 35 U.S.C. 154(b) by 0 days.

(21) Appl. No.: 13/014,403

(22) Filed: Jan. 26, 2011

(65) Prior Publication Data

US 2011/0115255 A1 May 19, 2011

Related U.S. Application Data

(62) Division of application No. 12/759,150, filed on Apr. 13, 2010, now Pat. No. 7,905,534, which is a division of application No. 10/958,043, filed on Oct. 4, 2004, now Pat. No. 7,695,053.

(60) Provisional application No. 60/562,764, filed on Apr. 16, 2004.

(51) Int. Cl.
*B62D 25/04* (2006.01)
*B60J 1/00* (2006.01)

(52) U.S. Cl. ..... 296/181.1; 296/84.1; 296/187.08; 296/187.12; 296/193.06; 296/193.07

(58) Field of Classification Search ..... 296/187.07, 296/191, 197.12, 146.1, 136.07, 202, 187.03, 296/148, 193.06, 187.12, 181.1; 89/36.07, 89/36.08; 411/338
See application file for complete search history.

(56) References Cited

U.S. PATENT DOCUMENTS 787,065 A 4/1905 White
(Continued)

FOREIGN PATENT DOCUMENTS

DE 3627485 2/1988
(Continued)

OTHER PUBLICATIONS

Simula Government Products Inc., Remak Retrofittable Modular Armor Kit, 1993 AUSA Annual Meeting, Oct. 18-20, 1993, 2 pages.

*Primary Examiner* — Glenn Dayoan
*Assistant Examiner* — Sunsurraye Westbrook
(74) *Attorney, Agent, or Firm* — Wood, Herron & Evans, LLP

(57) ABSTRACT

A field configurable vehicle armoring system and associated method allow a user to retrofit and reconfigure a combination of armor components in response to a perceived threat change and using original equipment manufacture fasteners and holes. The system includes pillar armor attachable after an original equipment manufacture door and hinge are removed. Fasteners extend through the hinge of the armored door, the pillar armor and an original equipment manufacture pillar using holes other than the original equipment manufacture holes. Rocker panel and underbody armor is further provided, along with a ballistic resistant windscreen and rear wall armor. Where desired, system armor includes a composite plate comprising a strike face that is constructed from softer metallic material than an inner metallic sheet.

13 Claims, 10 Drawing Sheets

U.S. PATENT DOCUMENTS

| | | | | |
|---|---|---|---|---|
| 796,768 | A | | 8/1905 | Steinmetz |
| 2,348,130 | A | | 5/1944 | Hardy, Jr. |
| 2,389,579 | A | | 11/1945 | Reynolds |
| 2,399,691 | A | | 5/1946 | Partiot |
| 2,758,660 | A | | 8/1956 | Bouffort |
| 3,575,786 | A | | 4/1971 | Baker et al. |
| 3,699,842 | A | | 10/1972 | Grewing et al. |
| 3,765,299 | A | | 10/1973 | Pagano et al. |
| 4,061,815 | A | | 12/1977 | Poole, Jr. |
| 4,111,097 | A | | 9/1978 | Lasker |
| 4,131,053 | A | | 12/1978 | Ferguson |
| 4,186,648 | A | | 2/1980 | Clausen et al. |
| 1,498,454 | A | | 4/1980 | Norton |
| 4,312,145 | A | | 1/1982 | Lukavich |
| 4,323,000 | A | | 4/1982 | Dennis et al. |
| 4,326,445 | A | | 4/1982 | Bemiss |
| 4,351,558 | A | * | 9/1982 | Mueller ..... 296/203.01 |
| 4,398,446 | A | | 8/1983 | Pagano et al. |
| 4,404,889 | A | | 9/1983 | Miguel |
| 4,529,640 | A | | 7/1985 | Brown et al. |
| 4,566,237 | A | | 1/1986 | Turner |
| 4,716,810 | A | | 1/1988 | De Guvera |
| 4,727,789 | A | | 3/1988 | Katsanis et al. |
| 4,841,838 | A | | 6/1989 | Scully et al. |
| 4,965,138 | A | | 10/1990 | Gonzalez |
| 5,059,467 | A | | 10/1991 | Berkovitz |
| 5,179,244 | A | | 1/1993 | Zufle |
| 5,314,230 | A | | 5/1994 | Hutchison et al. |
| 5,435,226 | A | | 7/1995 | McQuilkin |
| 5,448,938 | A | | 9/1995 | Fernandez et al. |
| 5,533,781 | A | | 7/1996 | Williams |
| 5,536,057 | A | * | 7/1996 | Stewart ..... 296/24.46 |
| 5,663,520 | A | | 9/1997 | Ladika et al. |
| 5,723,807 | A | * | 3/1998 | Kuhn, II ..... 89/36.02 |
| 6,041,689 | A | | 3/2000 | Lair et al. |
| 6,216,579 | B1 | | 4/2001 | Boos et al. |
| 6,363,830 | B1 | * | 4/2002 | Gonzalez ..... 89/36.01 |
| D464,913 | S | * | 10/2002 | Cerny et al. ..... D12/86 |
| 7,114,764 | B1 | | 10/2006 | Barsoum et al. |

FOREIGN PATENT DOCUMENTS

| | | | | |
|---|---|---|---|---|
| DE | 10250132 | A1 | * | 5/2004 |
| FR | 2706997 | | | 12/1994 |
| JP | 44136699 | | | 5/1992 |
| WO | WO 2006037314 | A1 | * | 4/2006 |

* cited by examiner

LETHAL THREAT PROTECTION SYSTEM FOR A VEHICLE AND METHOD

CROSS-REFERENCE TO RELATED APPLICATIONS

This application is a divisional of U.S. patent application Ser. No. 12/759,150 filed Apr. 13, 2010, hereby incorporated by reference herein as if fully set forth in its entirety, which is a divisional of U.S. patent application Ser. No. 10/958,043 filed Oct. 4, 2004, now U.S. Pat. No. 7,695,053 issued Apr. 13, 2010, hereby incorporated by reference herein as if fully set forth in its entirety, which claims the benefit of U.S. Provisional Patent Application Ser. No. 60/562,764, filed Apr. 16, 2004 by David J. Wolf et al. entitled "Field Retrofittable and Reconfigurable Lethal Threat Protection System for a Vehicle and Method," which application is incorporated by reference herein.

FIELD OF THE INVENTION

This invention relates generally to armoring, and more particularly to an armoring system for military land vehicles and other types of vehicles and structures.

BACKGROUND OF THE INVENTION

Military operations require many different types of land vehicles. One type of military land vehicle is a high speed, high mobility, reconnaissance vehicle, for example, a High Mobility Multipurpose Wheeled Vehicle ("HMMWV"). All types of military land vehicles may encounter various types of lethal threats, for example, ballistic threats, explosive threats, etc. Ballistic threats are presented by bullets and other projectiles; and explosive threats are presented by anti-tank mines, anti-personnel mines, claymores, improvised explosive devices ("IEDs"), etc. Explosive threats are often detonated by the pressure of one or more of the tires or wheels of the vehicle rolling over them or by remote detonation. Some explosive devices create a blast pressure for destructive incapacitive effect, whereas other explosive devices have a lower blast pressure and rely primarily on hundreds of flying shrapnel fragments for incapacitation effect. It is known to armor a perimeter of a vehicle to protect it from ballistic threats and to provide an underbody of the vehicle with blast shields to protect it from explosive threats. However, the type of protection chosen is determined by the threat perceived by a user.

There are many different models of the HMMWV; and as manufactured, an original equipment manufacture ("OEM") HMMWV does not have armor or blast shields to protect occupants from lethal threats. Consequently, lethal threat protection systems using combinations of armor and blast shields have been developed for the OEM HMMWV, for example, see U.S. Pat. Nos. 5,663,520 and 4,326,445. In known lethal threat protection systems, the armor and blast shields are mounted on the vehicle by a supplier of the protection system, either at the supplier's factory or by the supplier's personnel or field technicians at a location other than the factory site. Further, there is a common characteristic of known protection systems, that is, the armor and blast shields are permanently applied to the vehicle. Although the armor and blast shields can be removed, a substantial and very costly restoration effort is generally required to restore the vehicle to its original unarmored use. Therefore, known lethal threat protection systems that have been installed on vehicles are most often considered permanent by their owners and users.

While the above approach has proven satisfactory, it does have some disadvantages. First, a HMMWV may not always be exposed to lethal threats; and it may be desirable to return the vehicle to its OEM use, that is, civilian, nonmilitary use. Thus, to burden a vehicle with a lethal threat protection system over its whole useful life is very costly in terms of vehicle operation, user comfort maintainability and vehicle life. Therefore, there is a need for a lethal threat protection system that is effective at providing explosive protection to its occupants but can also be readily removed from the vehicle when such protection is no longer necessary.

Another disadvantage of known permanent vehicle armoring systems is that such systems cannot be changed as changes in circumstances dictate, The exposure to lethal threats is not the same everywhere; but with known systems, there is only one practical way to deal with such variations, that is, apply the maximum armor to the vehicle, so that it can be used anywhere. Such an approach is, in many respects, costly and inefficient. Therefore, there is a need to permit a user of the vehicle armoring system to be able to reconfigure the armoring system to the user's current needs.

SUMMARY OF THE INVENTION

The present invention provides a vehicle armoring system that may be installed in the field by a user. The vehicle armoring system of the present invention can also be quickly and cost effectively reconfigured and/or removed by the user. Thus, the vehicle armoring system of the present invention has the advantage of allowing a user to tailor the armoring system on the vehicle to changing perceived threats and circumstances. Further, the user is able to cost effectively return the vehicle to unarmored use.

One embodiment of the invention includes a field retrofittable and reconfigurable system that protects a vehicle occupant by providing pillar armor attachable to an outside vehicle surface after an OEM door and hinge are removed. An armored door of the system has a hinge, and fasteners extend through the hinge of the armored door; the pillar armor and an OEM pillar using holes other than the vehicle OEM holes. The armor fasteners, pillar armor and the armored door are removable from the vehicle to permit the OEM hinge and door to be reconnected to the OEM pillar by the OEM fasteners extending through the OEM holes.

More particularly, the system includes an A pillar reinforcement adapted to be located adjacent an inner surface of an OEM pillar. This A pillar reinforcement is typically secured in place by armor fasteners, The system further includes B pillar armor adapted to be attached to an OEM B pillar after removal of an OEM rear door hinge and an OEM rear door. To this end, armor fasteners extend through a hinge of an armored rear door, the B pillar armor and the OEM B pillar using holes other than the OEM holes in the OEM B pillar. The B pillar armor and the armored rear door are removable from the OEM B pillar and permit the OEM rear door to be reconnected to the OEM B pillar by fasteners that extend through the OEM holes in the OEM B pillar.

Additional rocker panel protection provided by the system includes rocker panel armor positioned on each side of the vehicle and adapted to be attachable with fasteners to a respective side extending from the A pillar armor to the rear wheel well below the armored door. The rocker panel may be removed from the vehicle.

Another or the same embodiment includes windscreen protection. The windscreen protection includes a ballistic resistant windscreen mounted in a frame adapted to be located in a peripheral channel that extends into a front surface of an OEM windscreen frame. Armor caps extend around a periphery of the frame, and armor fasteners extend through the armor caps and into holes in the OEM windscreen frame, other than the OEM holes. The armor fasteners, armor caps and the ballistic resistant windscreen are removable from the peripheral channel and permit the OEM windscreen to be remounted in the peripheral channel by the OEM fasteners that extend through the OEM holes.

Front underbody protection provided by an embodiment of the present invention includes a pair of reinforcing plates. Each of the reinforcing plates is adapted to be located adjacent one of two opposing side walls of a forward portion of the vehicle. The reinforcing plates are typically connected with fasteners to the vehicle. The underbody protection feature further includes a blast resistant shield adapted to cover external areas of the forward portion of the vehicle. The blast resistant shield is typically located between an anticipated source of a blast and the forward portion of the vehicle. Fasteners connecting the blast resistant shield to the vehicle are removable. This blast resistant shield feature absorbs energy and a pressure wave from a lethal threat by bending and deforming.

A rear wall protection feature on an embodiment includes armor adapted to be attachable with fasteners to a lowermost surface of a rear wheel well. The armor extends upward adjacent a forward surface of the rear wheel well. Fasteners and the armor are configured to be removable from the rear wheel well.

An embodiment further includes front armor adapted to be attachable with fasteners to the vehicle adjacent a forward surface of a forward position in which the lower legs and feet of an occupant are positioned. The fasteners and the forward armor are configured to be removable from the vehicle.

Where desired, armor includes a composite plate that includes a strike face that is constructed from softer metallic material than an inner metallic sheet. The relatively softer and tougher strike face of the composite plate mitigates dangers associated with penetration of lethal threats.

A method of attaching in the field retrofitable and reconfigurable lethal threat protection system includes removing at least one OEM component and drilling fastener holes in the vehicle that do not overlap or interfere with OEM holes. A component of the lethal threat protection system that substitutes for the OEM component is mounted using second fasteners and fastener holes. The second fasteners and component of the lethal threat protection system is subsequently removed, and the OEM-component is thereafter reinstalled using the OEM holes.

Embodiments of the present invention thus allow a user to retrofit and reconfigure a combination of the components of the perimeter armor feature and/or the underbody blast protection features in the field. A user may readily reconfigure the components in response to a perceived threat change. The user may further remove any or all of the components of the system and reinstall OEM component using OEM fasteners and holes.

These and other objects and advantages of the present invention will become more readily apparent during the following detailed description taken in conjunction with the drawings herein.

DETAILED DESCRIPTION OF THE INVENTION

Figure 1:
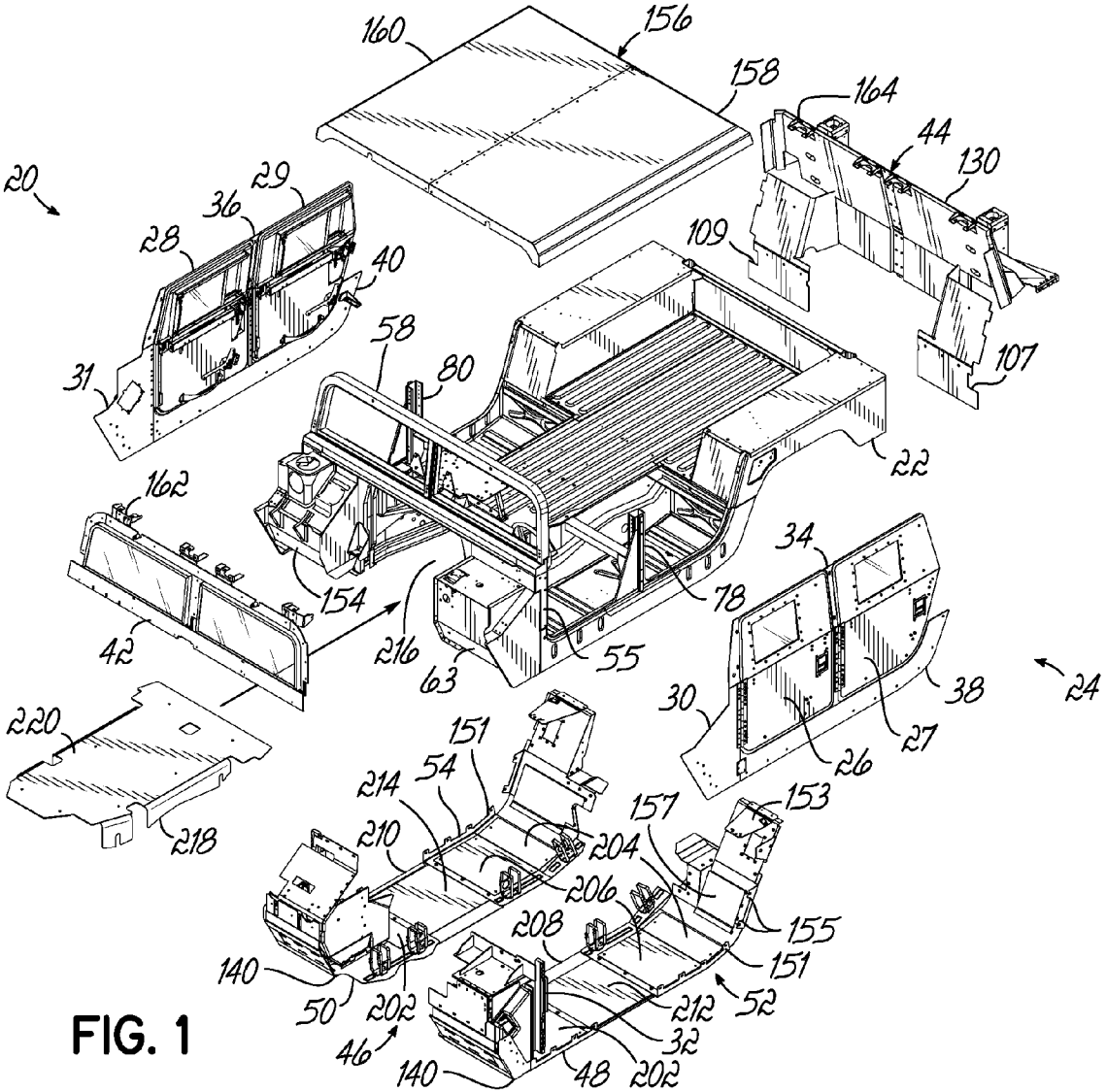
FIG. 1 is a disassembled perspective view of a field retrofittable and reconfigurable lethal threat protection system for a HMMWV in accordance with the principles of the present invention.

Referring to FIG. 1, a field retrofittable and reconfigurable lethal threat protection system 20 is shown in association with an OEM body 22 of a HMMWV. The protection system 20 includes a perimeter armor system 24 that is made from known armor materials chosen to provide a desired level of protection from ballistic threats such as bullets. The perimeter armor system 24 includes front and rear left armored doors 26, 27, front and rear right armored doors 28, 29, left and right A pillar armor 30, 31, left and right A pillar reinforcements 32, 33, left and right B pillar armor 34, 36, left and right rocker panel armor 38, 40, e ballistic resistant windscreen 42 and rear vehicle armor 44. The lethal threat protection system 20 further includes an underbody blast protection system 46 that is made from known armor materials chosen to provide a desired level of protection from explosive threats. The underbody blast protection system 46 includes left and right front underbody blast shields 48, 50 and left and right rear underbody blast shields 52, 54.

As received from an OEM vehicle supplier, OEM fasteners extend through holes of an OEM hinge for an OEM door and then through OEM holes in the A pillar 55. The OEM fasteners are threaded into nuts welded or otherwise attached to a rear side of the OEM A pillar 55, thereby securing the left front OEM door to the OEM A pillar 55. The OEM fasteners are removed in order to remove the OEM left front and rear doors. In the Figs., the OEM doors have been removed; and the OEM windscreens that mount in an OEM windscreen frame 58 have also been removed.

Figure 2:
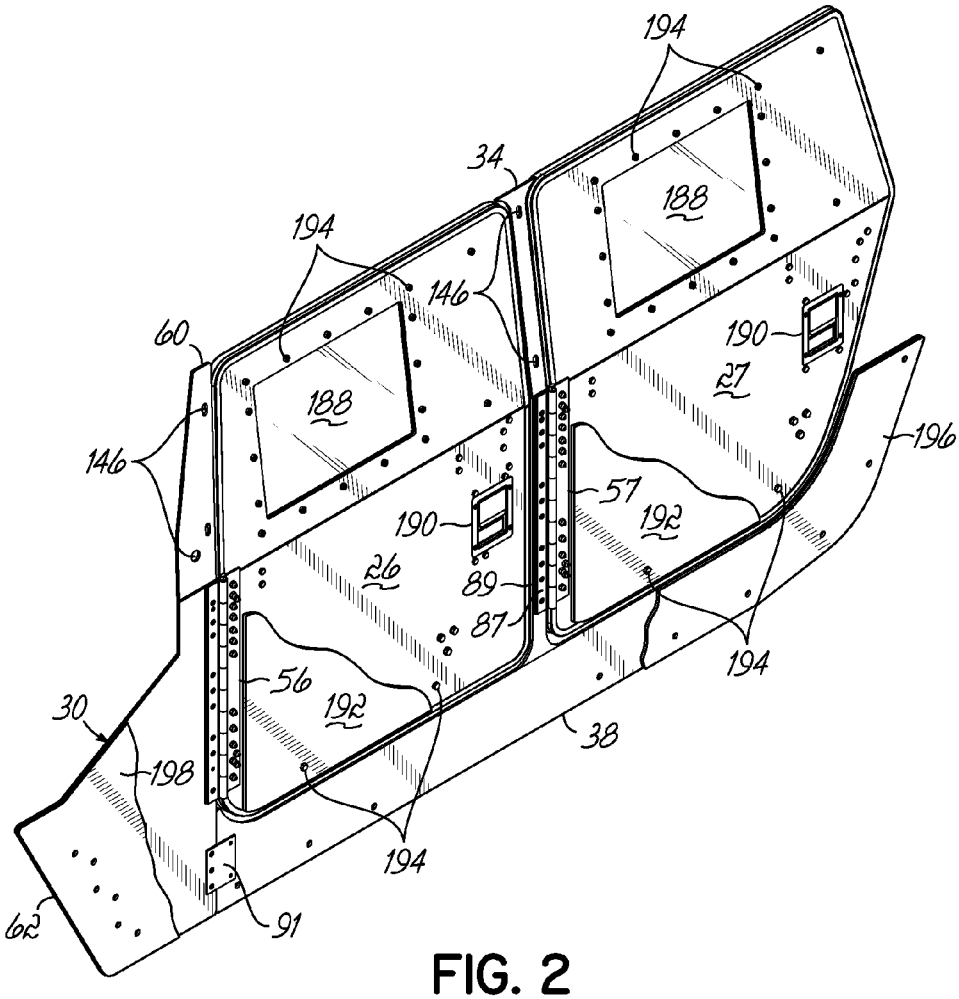
FIG. 2 is a perspective view of armored doors, A and B pillar armor and rocker panel armor of the field retrofittable and reconfigurable lethal threat protection system of FIG. 1.

The A pillar armor, A pillar reinforcements, B pillar armor, armored doors and rocker panel armor of the perimeter armor system 24 are substantially the same on both the left and right sides of the vehicle body 22; and therefore, only the left side of the perimeter armor system 24 will be described in detail. As shown in FIG. 2, the left side A pillar armor 30, B pillar armor 34, armored front and rear doors 26, 27 and rocker panel protection 38 can be installed. The armored front and rear doors 26, 27 are made of a ballistic resistant armor and utilize transparent armor in a known manner. The A pillar armor 30 has a first portion 60 that extends over the A pillar and an extension 62 that protects a left front foot well 63 (FIG. 1) of the HMMWV body 22 in a known manner.

Holes for mounting the hinge 56 are located by using A pillar armor 30 that has first holes that are alignable with OEM hinge holes on the OEM A pillar 55, which are used to mount the OEM left front door hinge. After removing the OEM left front door, the first holes in the A pillar armor 30 are located over the OEM hinge holes, and the A pillar armor 30 is mounted on the OEM A pillar 55 using the fixed nuts that are used to secure the OEM hinge. The A pillar armor 30 has second holes therein that locate holes for mounting the hinge 56 of the armored door 26. The A pillar armor 30 is used as a drill guide to drill holes through the vehicle body 22 and the OEM pillar 55 for mounting the hinge 56. It should be noted that the second holes in the A pillar armor 30 do not overlap the first holes. The A pillar armor 30 is then removed from the OEM A pillar 55.

Figure 3:
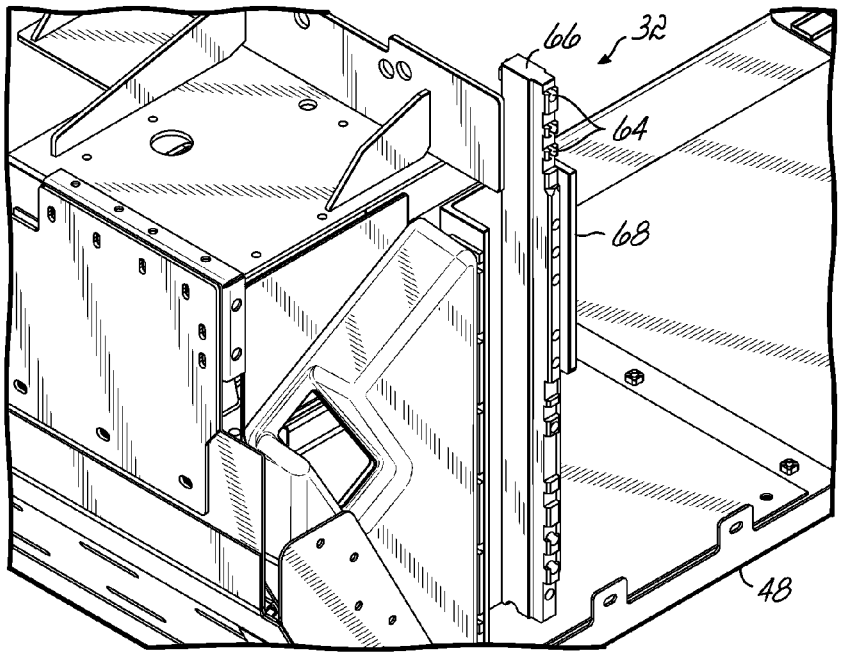
FIG. 3 is a perspective view of an A pillar reinforcement of the field retrofittable and reconfigurable lethal threat protection system of FIG. 1, which is mounted on an interior of the HMMWV body.
Figure 4:
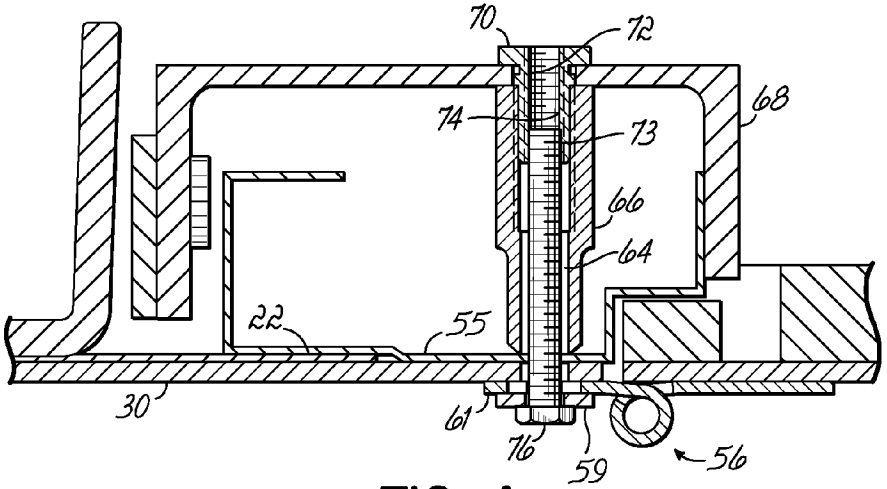
FIG. 4 is a cross-sectional view of an armored and reinforced A pillar assembly of the field retrofittable and reconfigurable lethal threat protection system of FIG. 1.

As shown in FIG. 3, the OEM A pillar 55 is reinforced by a bar 66 having through-holes 64. The bar 66 is mounted inside of the body 22 behind the OEM A pillar, and the bar 66 is connected to a U-shaped channel 68 that provides further support and strength to the OEM A pillar. After the A pillar reinforcement 66, 68 is located behind the OEM A pillar, the A pillar armor 30 is set in place; and the armored door 26 and hinge 56 are placed on the vehicle body 22. As shown in FIG. 4, a washer plate 59 is located over hinge plate 61 that is placed against the A pillar armor 30. A double nut 70 extends through a clearance hole 72 of the channel 68 and, via threads 73, is threaded into the bar 66 to secure the armored A pillar assembly together. The double nut 70 has a threaded center hole 74 that receives a bolt 76, thereby securing the various components of the A pillar assembly together. The threads 73 may be opposite the threads on the bolt 76, so that as the bolt 76 is tightened, the double nut 70 is also tightened.

Using the washer plate 59, the holes in the hinge plate 61, the A pillar armor 30 and the bar 65 do not overlap any of the OEM holes in the OEM body 22 that are used to attach the OEM doors, Therefore, if it is desired to remove the armored door 26, the A pillar armor 30 and the A pillar reinforcement 32, the bolts 76 and double nuts 70 are removed, thereby releasing all of the armored components from the OEM vehicle body 22 and permitting the OEM doors to be reinstalled utilizing the OEM fasteners and OEM holes in the OEM body 22.

Figure 5A:
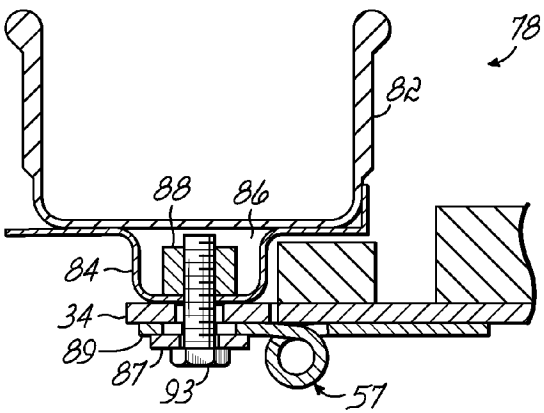
FIG. 5A is a cross-sectional view of an armored B pillar assembly of the field retrofittable and reconfigurable lethal threat protection system of FIG. 1.
Figure 5:
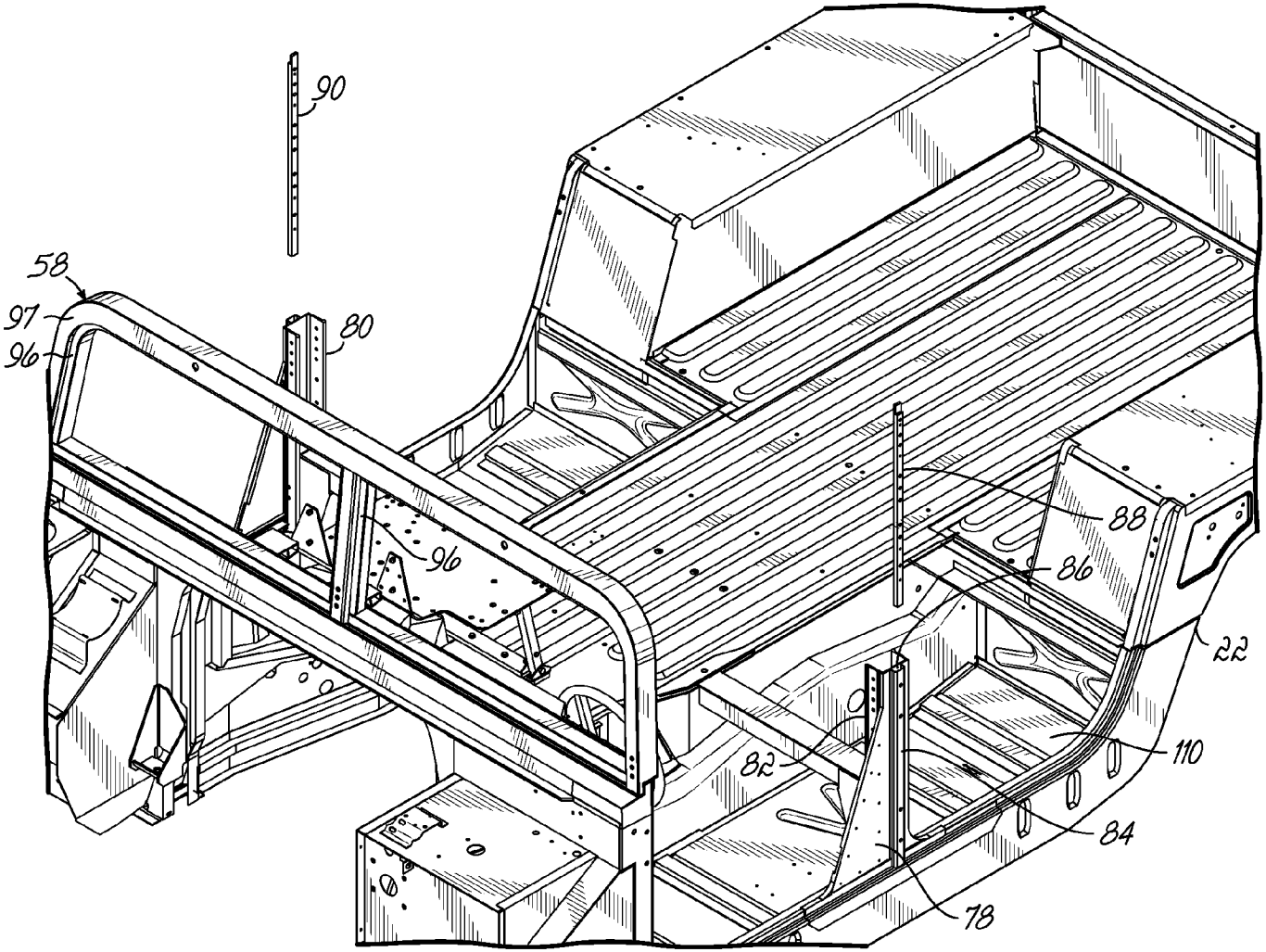
FIG. 5 is a partial perspective view of the B pillars of the HMMWV body that are used to support the B pillar armor of the field retrofittable and reconfigurable lethal threat protection system of FIG. 1.

Referring to FIGS. 5 and 5A, the OEM body 22 has opposed left and right OEM B pillars 78, 80. The B pillar armoring on the left and right sides is substantially identical, and therefore, only the left side B pillar armor will be described in detail. As shown in FIG. 5A, the OEM B pillar 78 is comprised of a U-shaped channel 82 and a top hat shaped channel 84 rigidly connected thereto. The assembly of the channels 82, 84 forms a vertical slot 86, which contains an OEM strip of nuts (not shown) that receive bolts through OEM holes in the top hat shaped channel 84 to attach an OEM hinge (not shown) of an OEM rear door (not shown) to the OEM body 22. Before armoring the OEM B pillar 78, the OEM rear door is removed as well as the OEM strip of nuts. Thereafter, a tapping strip 88 (FIG. 5) is inserted in the slot 86. Tapping strip 88 has first threaded holes located at positions that line up with holes on the OEM rear door hinge. Thus, the tapping strip 88 can be used to remount the OEM rear door to the B pillar 78 and is the only piece of the protection system 20 that is left on the vehicle body 22 after the protection system 20 has been removed. The tapping strip 88 also has second threaded holes that are used in mounting the B pillar armor 34 to the B pillar 78.

Holes for mounting a hinge plate 89 (FIG. 5A) of the hinge 57 to the OEM B pillar 78 are located by using a washer plate 87 that has first holes alignable with OEM hinge holes on the OEM B pillar 78. The first holes in the washer plate 87 are located over the B pillar 78, and the washer plate 87 is temporarily clamped to the OEM B pillar 78. The washer plate 87 has second holes therein that locate holes for mounting the hinge plate 89 of the hinge 57 of the armored rear door 27. The washer plate 87 is used as a drill guide to drill holes in the top hat shaped channel 84 for mounting the hinge 57. It should be noted that the second holes in the washer plate 87 do not overlap the first holes. The washer plate 87 is then removed from the OEM B pillar 78.

To mount the B pillar armor 34, the B pillar armor 3 is set in place; and the armored door 27 is placed on the vehicle body 22. The washer plate 87 is placed over hinge plate 89 of the hinge 57, which, in turn, is placed over the B pillar armor 34. Bolts 93 extend through the second holes in the washer plate 87, holes in the hinge plate 89, holes in the armor plate 34 and drilled holes in the top hat shaped channel 84. The bolts 93 are secured by the second threaded holes in the tapping strip 88.

Referring to FIGS. 1 and 2, the left and right side rocker panel armor 38, 40 is substantially the same in construction and is installed with bolts or other fasteners to the vehicle body 22. Each of the left and right side rocker panel armor 38, 40 is made from a single piece of armor and has holes that not only accept fasteners but also provide a drilling template for drilling holes in the HMMWV body 22. The holes in the rocker panel armor 38, 40 are located such that the holes in the HMMWV body 22 extend through the side skin and a peripheral flange of the floor panel. As shown in FIG. 2, a metal strap 91 connects the left side rocker panel armor 38 to the A pillar armor 30. A similar plate (not shown) is used to connect the right side rocker panel armor 40 with the right side A pillar armor 31.

Figure 6:
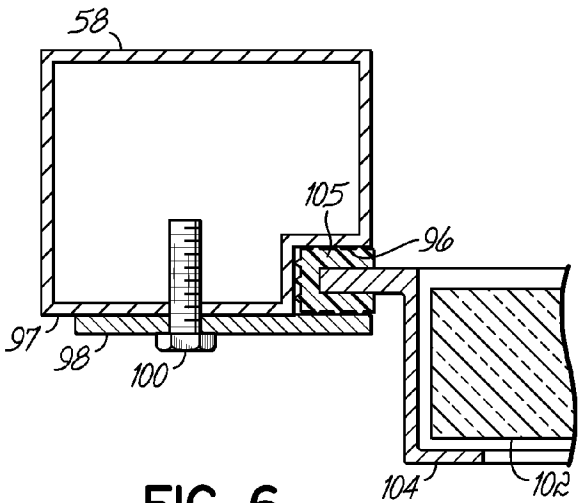
FIG. 6 is a cross-sectional view of a mounting of a ballistic resistant windscreen of the field retrofittable and reconfigurable lethal threat protection system of FIG. 1.
Figure 7:
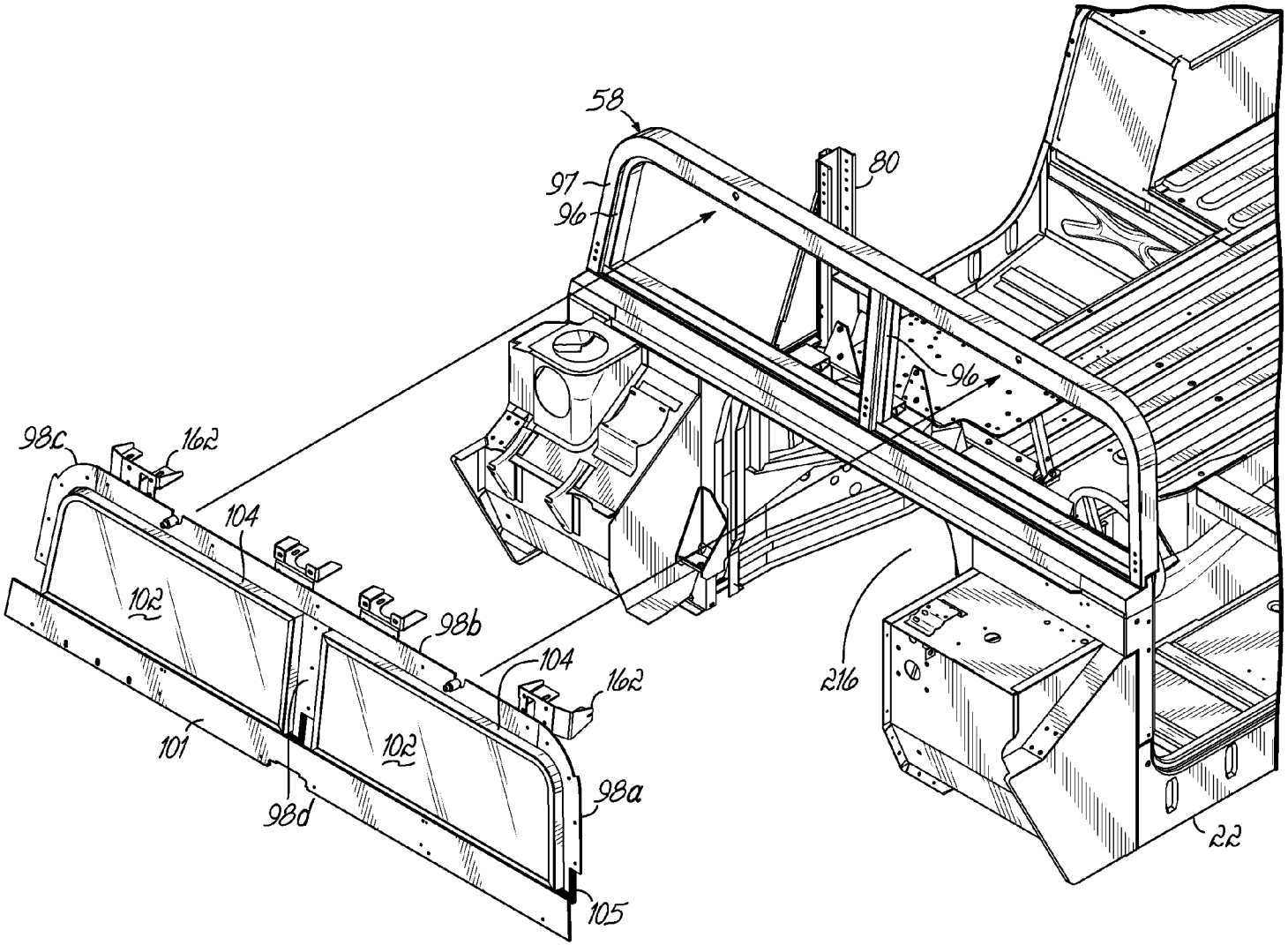
FIG. 7 is a front perspective view of the ballistic resistant windscreen of the field retrofittable and reconfigurable lethal threat protection system of FIG. 1.
Figure 8:
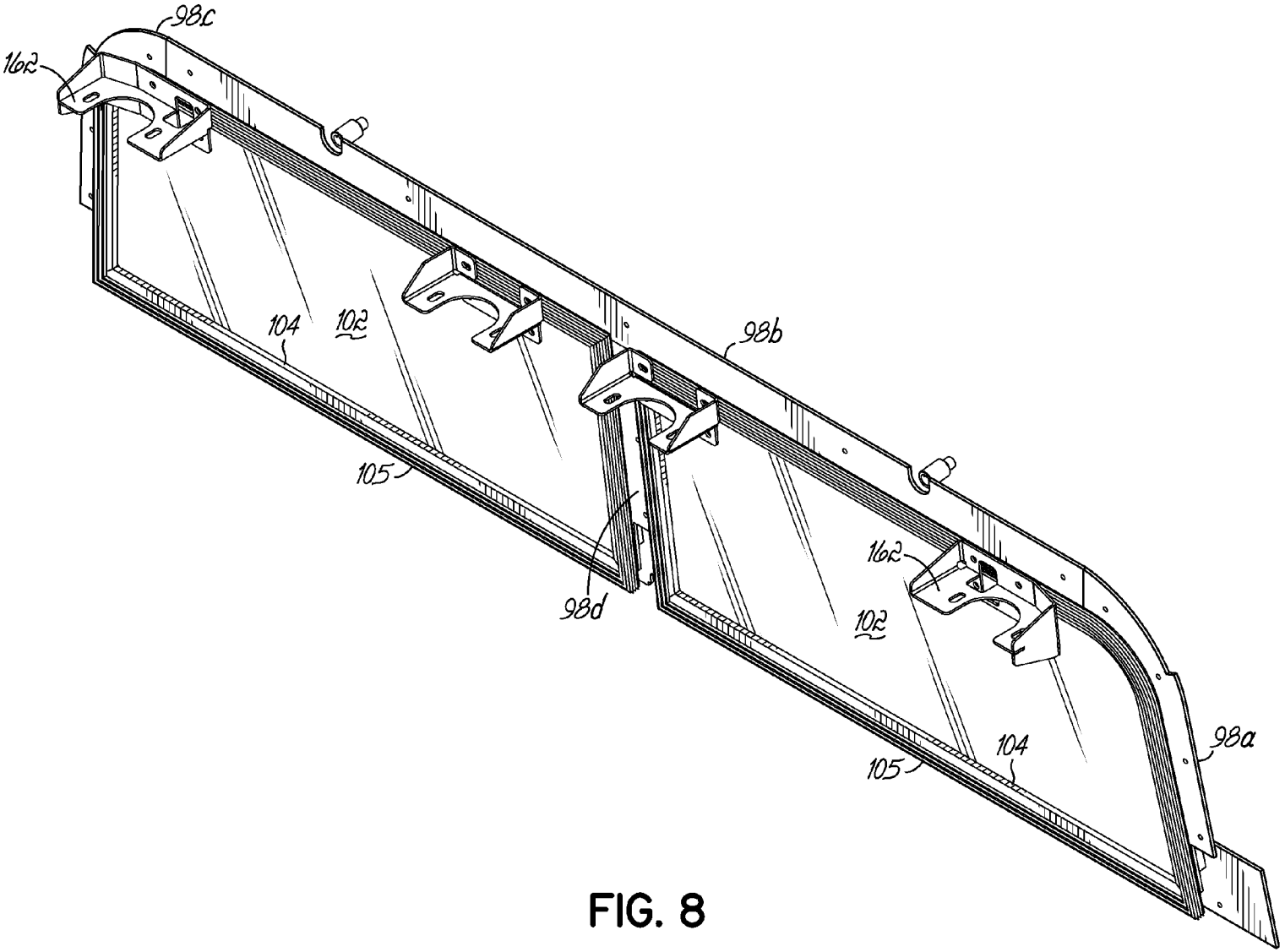
FIG. 8 is a rear perspective view of the ballistic resistant windscreen of the field retrofittable and reconfigurable lethal threat protection system of FIG. 1.

Referring to FIGS. 6 and 7, the OEM windscreen frame 58 has left and right peripheral channels 96 disposed inward from a front surface 97 of the windscreen frame 58. OEM windscreens (not shown) are secured in the channels 96 by clamping frames (not shown) that are secured to the OEM windscreen frame 58 by OEM fasteners. Upon removing the OEM fasteners and the OEM clamping frames, the OEM windscreens can be removed and replaced by transparent armor, such as a ballistic resistant windscreens 102 supported in respective Z-channels 104 by adhesive or other means. As shown in FIGS. 7 and 8, seals 105 are mounted on a rearward side of respective Z-channels 104 and windscreens 102. The seals 105 and windscreens 102 are then placed in the OEM windscreen frame 58, Pieces of capping armor 98*a*, 98*b*, 98*c*, 98*d* are then place over the seal 105 and Z channel 104. The capping armor 98*a*-98*d* has manufactured holes that function as a drill guide for drilling new holes in the OEM windscreen frame 58. The new holes are tapped, and bolts 100 (FIG. 6) are then used to secure the capping armor 98*a*-98*d* and ballistic resistant windscreens 102 in the OEM windscreen frame 58. A deflector panel 101 is mounted along a lower edge of the windscreens 102.

Figure 9:
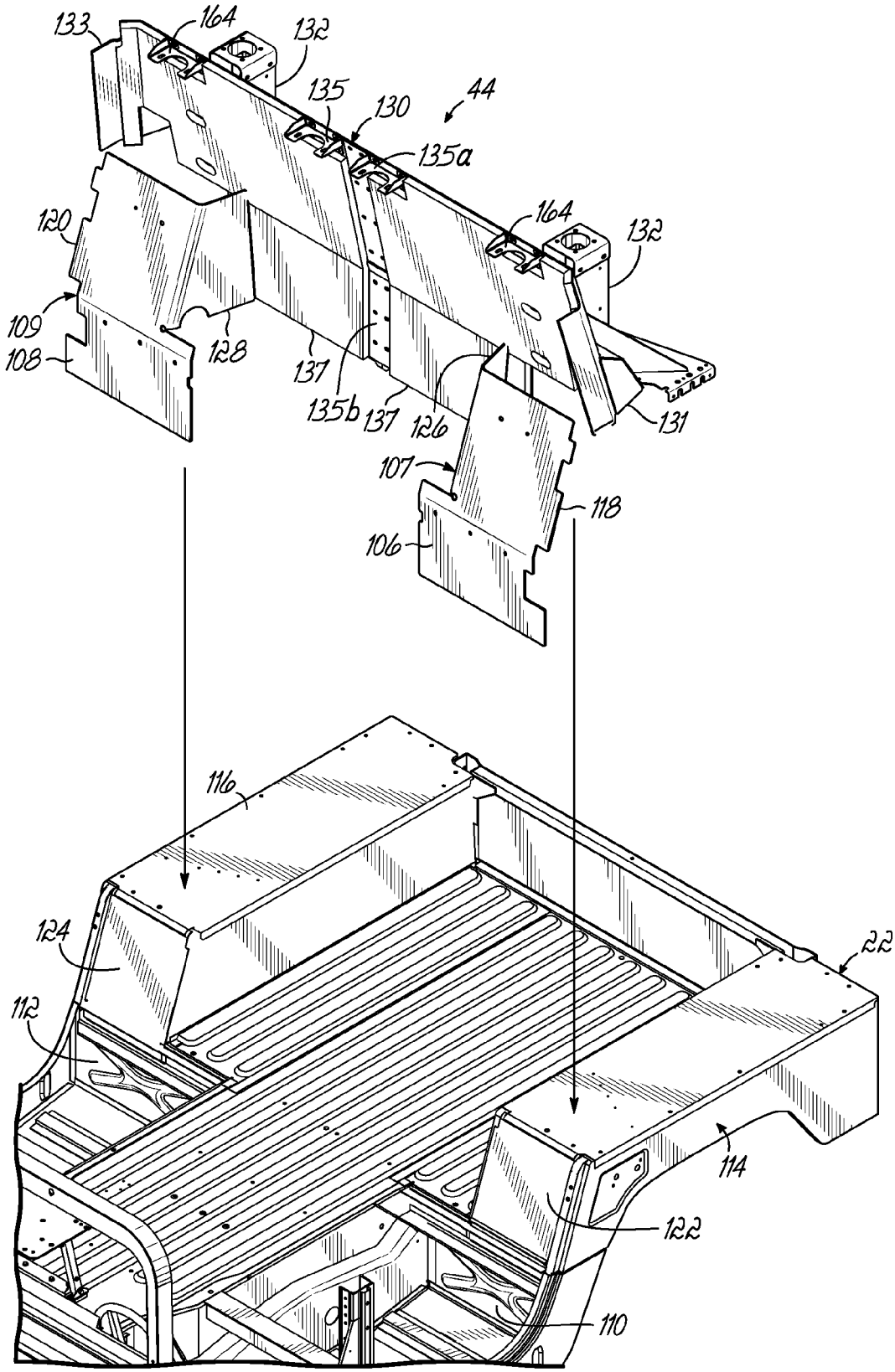
FIG. 9 is a perspective view of rear vehicle armor of the field retrofittable and reconfigurable lethal threat protection system of FIG. 1.

Referring to FIG. 9, the perimeter armor system 24 further includes rear vehicle armor 44 that is mounted on the OEM body 22 immediately behind occupants of the HMMWV. The rear vehicle armor 44 includes a rear partition armor 130 and left and right seat backing armor 107, 109 that provide rear gap protection. The rear partition armor 130 is an assembly of left and right partition armor plates 131, 133 that extend across the full area of the rear partition armor 130 and are joined by gap strips 135*a*, 135*b* in a known manner. Insulation 137 covers a major portion of an inside area of the rear partition armor 130 to protect occupants from heat.

The seat backing armor 107, 109 has respective first ballistic resistant armor areas 106, 108 that extend into respective foot wells 110, 112 forward of respective left and right wheel wells 114, 116. Contiguous with the armor areas 106, 108 are respective left and right armor areas 118, 120 that are located over respective left and right front sides 122, 124 of the respective left and right wheel wells 114, 116. Opposed left and right interior armor areas 126, 128 cover adjacent interior portions of the respective left and right wheel wells 114, 116. The rear partition armor 130 is attached to the outer portions of the wheel wells 114, 116 by fasteners extending through left and right brackets 132. In addition, fasteners are also used to connect the left and right seat backing armor 107, 109 to the wheel wells 114, 116. The use of the left and right seat backing armor 107, 109 substantially enhances the protection of occupants in the HMMWV from bullets and other ballistic threats.

Referring to FIG. 1, the underbody blast protection system 46 has respective left and right front underbody blast shields 48, 50. The primary purpose of the front underbody blast shields 48, 50 is to absorb the pressure wave and energy of an explosive blast by deflection and deformation. This is in contrast to underbody blast protection systems, which are designed to transfer blast forces to other components of the structure of the HMMWV body 22, Although the left and right front underbody blast shields 48, 50 have different shapes to conform to the different shapes of the left and right sides of the HMMWV body 22, the left and right front underbody blast shields 48, 50 are substantially the same in construction. Therefore, only the left front underbody blast shield 48 shown in FIGS. 10-12 will be described in detail.

Figure 11:
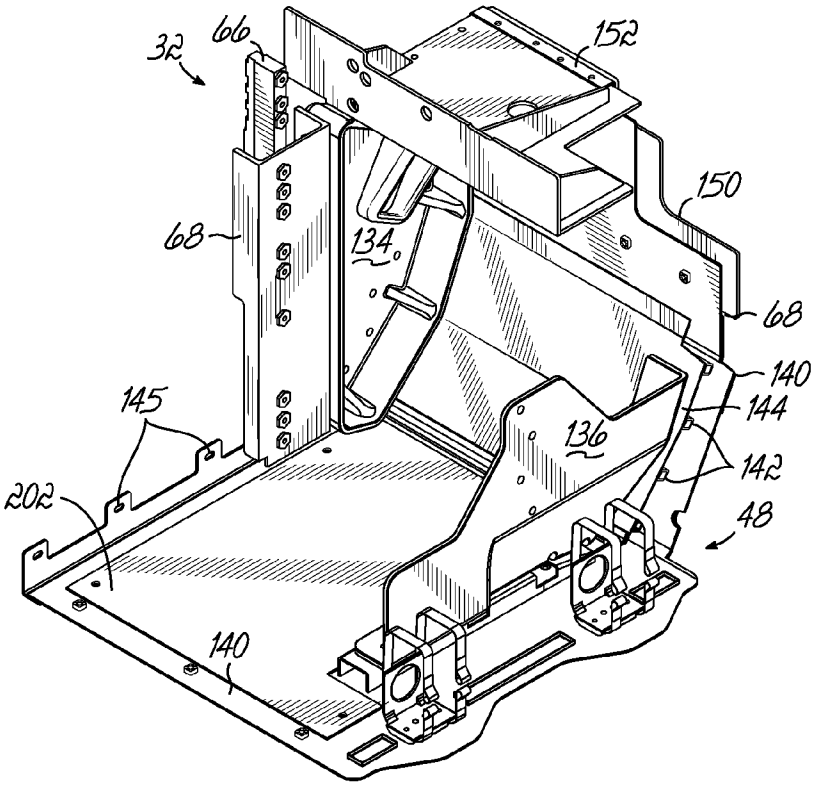
FIG. 11 is an inner perspective view of a left forward underbody blast shield of the field retrofittable and reconfigurable lethal threat protection system of FIG. 1.
Figure 10:
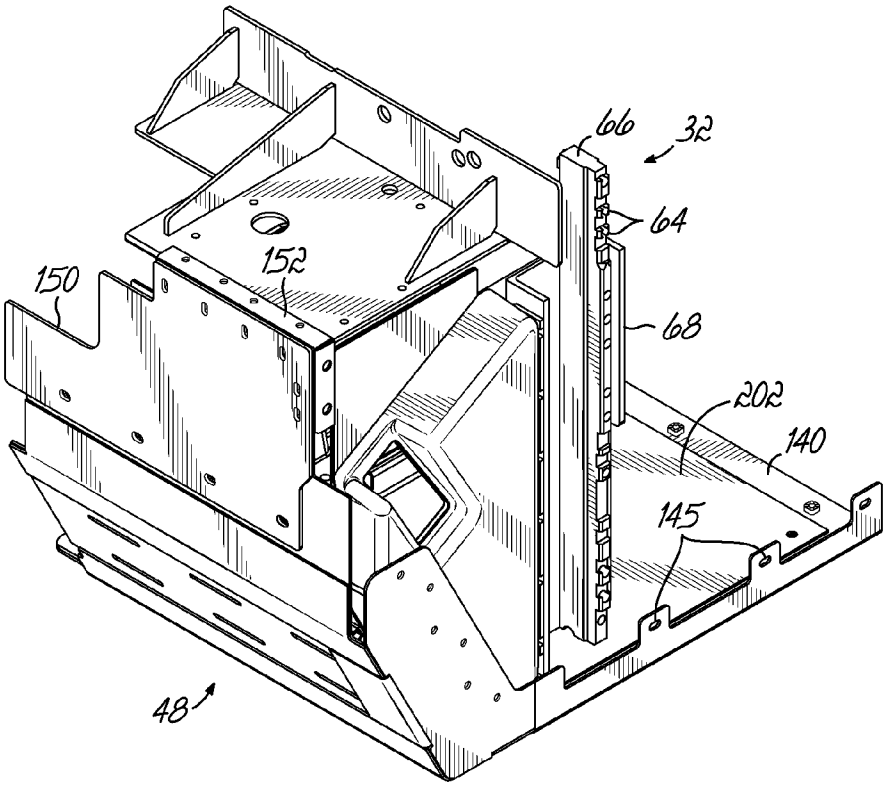
FIG. 10 is an outer perspective view of a portion of the left forward underbody blast shield of the field retrofittable and reconfigurable lethal threat protection system of FIG. 1.
Figure 12:
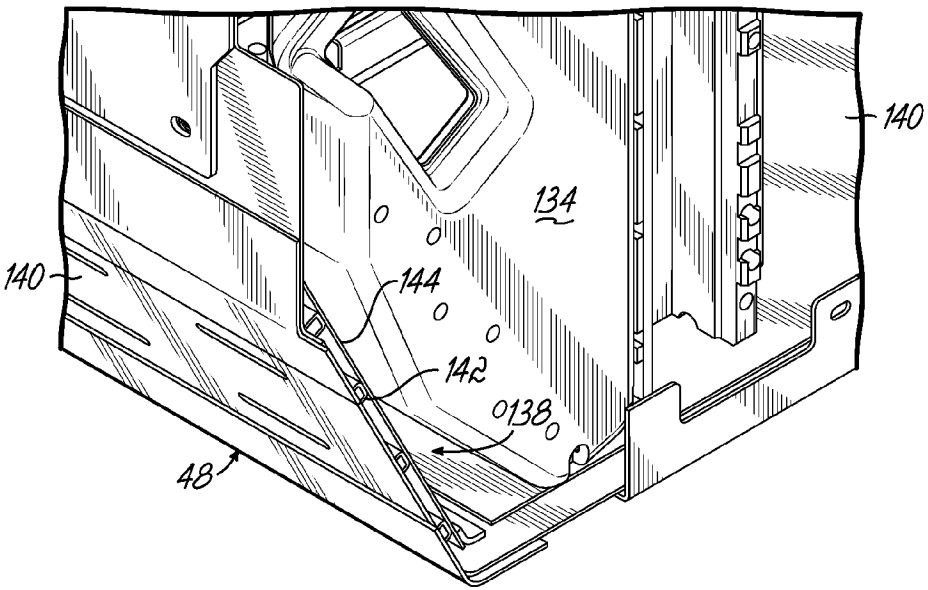
FIG. 12 is an outer perspective view of a portion of the left forward underbody blast shield of the field retrofittable and reconfigurable lethal threat protection system of FIG. 1.

Referring to FIGS. 10-12, the front underbody blast shield 48 has an outer plate 140 that extends across a bottom of the front foot well 63 (FIG. 1) of the HMMWV body 22. The outer plate 140 also extends angularly upward and forward of the front foot well 63 and then vertically upward to protect the forward potion of the front foot well. To provide additional blast protection in a direction of the anticipated blast, the front underbody blast shield 48 includes an assembly of structural steel tubes 142 that are sandwiched by welding between the outer plate 140 and an inner plate 144. The front underbody blast shield 48 is connected to the HMMWV body 22 by bolts or other fasteners via elongated holes 145 that facilitate positioning of the blast shield 48. Further, in the event of a blast, the front underbody blast shield 48 is able to move with respect to the fasteners in the elongated holes 145, thereby absorbing some of the blast energy. Elongated holes are used to mounted other armor components and serve the same dual purpose as described with respect to elongated holes 145. As shown in FIG. 11, the front underbody blast shield 48 also includes outer and inner liners 134, 136 that are attached to the HMMWV body with bolts or other fasteners in a known manner. As shown in FIG. 12, the blast shield 48 is separated from the outer reinforcing liner 134 by an air gap 138, thereby permitting deflection and deformation of the blast shield 48 to absorb the energy pressure wave of an explosive blast.

Left front gap ballistic protection is provided by armor plates 150, 152 that are mounted to and immediately above the left front blast shield 48. Right front gap protection armor is also provided. However, due to the structure of the HMMWV around the right front foot well 154 (FIG. 1), the right front gap protection armor is mounted on the inside of the right front foot well 154.

Figure 13:
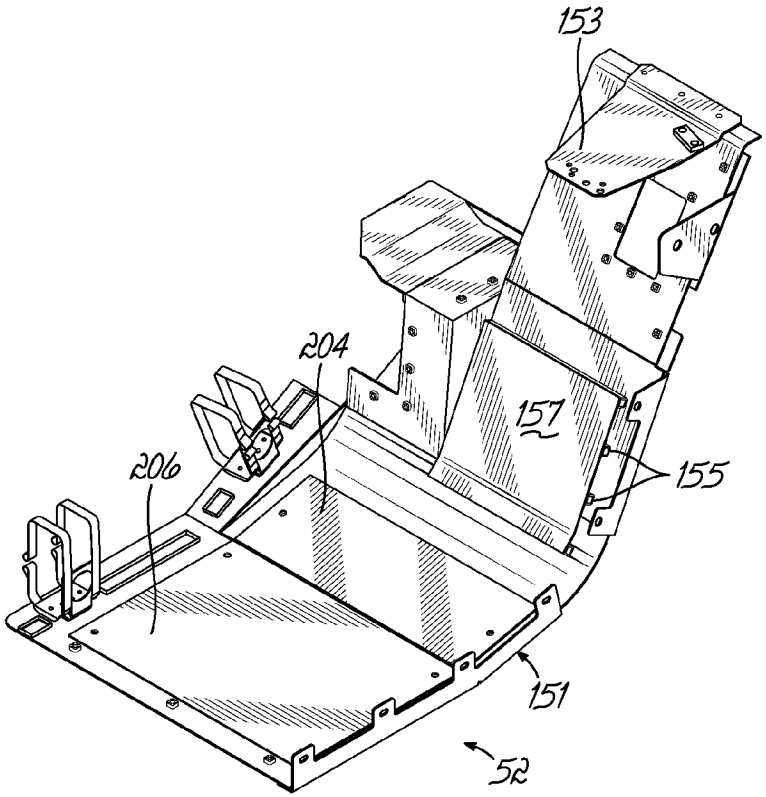
FIG. 13 is a perspective view of a left rear underbody blast shield of the field retrofittable and reconfigurable lethal threat protection system of FIG. 1.

Referring to FIG. 1, the left and right rear underbody blast shields 52, 54 provide rear underbody blast protection and are substantially the same in construction. Therefore, only the left rear underbody blast shield will be described in detail. As shown in FIG. 13, the rear underbody blast shield 52 has a lower plate 151 that extends across a bottom of the rear left foot well 110 (FIG. 9) of the HMMWV body 22. The lower plate 151 also extends angularly upward and rearward of the left rear wheel well 114. A flange 153 is used to connect the lower plate 151 to the left rear wheel well 114. To provide additional blast protection in a direction of the anticipated blast, the rear underbody blast shield 52 includes an assembly of structural steel tubes 155 that are sandwiched by welding between an upper plate 157, thereby providing a structure substantially identical to the protective plate structure of FIG. 12 comprising tubes 142 and plates 140, 144. The rear underbody blast shield 52 is connected to the HMMWV body 22 by bolts or other fasteners.

Referring to FIG. 1, a roof 156 is comprised of two hard roof sections 158, 160 that are interconnected by a gap strip (not shown) mounted on a lower side of the roof sections 158, 160 in a known manner. The roof 156 is resiliently mounted to the OEM body 22 via four support brackets 162 mounted near an upper edge of the windscreen frame 58 and four support brackets 164 mounted adjacent an upper edge of the rear partition 130. All of the resilient mounts are substantially identical and therefore, only one of the mounts connecting the roof section 158 to a support bracket 162 will be described in detail.

Figure 14:
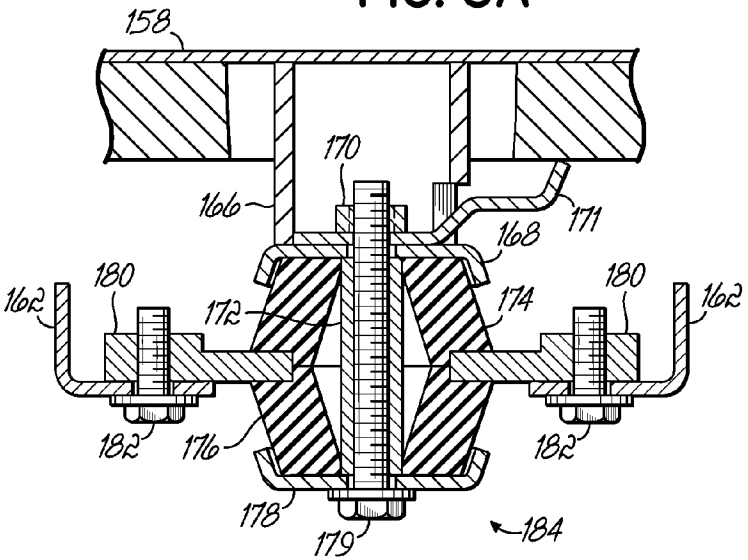
FIG. 14 is a side elevation view of a resilient mount used to support the roof of the field retrofittable and reconfigurable lethal threat protection system of FIG. 1.

Referring to FIG. 14, a tube 166 is rigidly affixed by welding or otherwise to a lower surface of the roof section 158. A nut 170 is fixed by welding or otherwise to a nut plate 171 that slides into tube 166 and is welded in place. A bolt 179 extends through a lower metal cap 178, respective lower and upper rubber pads 176, 174, an upper metal cap 168 and nut plate 171. The bolt 179 is threaded into the nut 170 to secure the resilient mounting assembly 184 together. The mounting bracket 180 is attached by fasteners 182 or otherwise to the support bracket 162 connected to the windscreen frame 58 (FIG. 1). Thus, the roof section 158 is resiliently mounted with respect to the HMMWV body 22 and provides protection for the occupants therein.

With known armoring systems, a portion of the vehicle skin is sandwiched between an armor plate and an aluminum composite plate to provide protection from spawling. With the present invention, the armored doors 26, 27, rocker panel armor 38 and A pillar armor 30 are made with a less brittle steel, for example, a tool steel, which provides protection from spawling; and therefore, the aluminum composite plate does not have to be used.

A more recent lethal threat is provided by an improvised explosive device ("IED"). An IED presents a threat that has the characteristics of both ballistic and blast threats, In order to protect against an IED threat, aluminum plates or shields are mounted on the vehicle. The aluminum sheet is about 0.750 inches thick and is often a commercially available 6061 aluminum.

In one embodiment, the aluminum sheet comprises a strike face of a composite plate that is mounted on vehicles to counteract threats, including IED's, The composite plate typically includes an inner sheet that comprises steel having a higher Rockwell C scale hardness rating than the aluminum sheet. The two sheets are typically mechanically fastened together, but may be welded or otherwise bonded together where advantageous. While aluminum presents certain advantages in specific applications, one skilled in the art will recognize that other metallic materials, i.e., those materials containing a metal, may be alternatively used for the strike face of the plate. As such, any metallic material used for the strike face of the embodiment will be softer than the inner sheet, that is, have a lower hardness rating. The inner sheet is typically less tough than the outer, strike face sheet, as well.

The relatively softer and tougher strike face of the composite plate produces unexpectedly advantageous results in mitigating the dangers associated with the penetration of IED's and other lethal threats. For instance, the softer and tougher strike face may absorb energy from a bullet, while the bullet pushes a plug size piece of the strike face away from the rest of the strike face sheet. The plug and bullet may consequently have insufficient force and focus to penetrate the relatively harder, inner sheet of the composite plate. Other advantages of the composite plate regard its manufacture and mounting onto the vehicle. Namely, the individual sheets of the composite plate are individually easier and cheaper to shape, transport, purchase and attach than a single sheet having a thickness comparable to the composite plate.

Referring to FIG. 2, perimeter or side body IED protection is accomplished by applying aluminum plates over the armored doors 26, 27, the rocker panel 38 and the A pillar armor 30. With the armored doors 26, 27, aluminum plates 192 are provided that are the same size of the doors 26, 27 but have openings corresponding to the size of door windows 188 and door handles 190. The aluminum plates 192 are mounted over the armored doors using existing bolt holes, for example, holes 194. In a similar manner, aluminum IED protection plates 196, 198 are provided, which are the same size as the rocker panel armor 38 and A pillar armor 30, respectively, The IED protection plates 196, 198 are applied over the respective rocker panel armor 38 and A pillar armor 30 using existing bolt holes. Similar perimeter protection may also be applied to the right side of the vehicle body 22.

Additional underbody protection from IED threats and fragments is also provided. Referring to FIGS. 1 and 10, aluminum plates 202 are bolted to each of the outer plates 140 of left and right front underbody blast shields 48, 50, Referring to FIGS. 1 and 13, aluminum plates 204, 206 are also bolted to each of the lower plates 151 of the left and right rear underbody blast shields 52, 54. In addition, the left and right side front underbody blast shields 48, 50 are connected to respective left and right rear underbody blast shields 52, 54 by armor plates 208, 210, respectively. The armor plates 208, 210 also have respective aluminum plates 212, 214 bolted thereto. The armor plates 208, 210 are connected to the respective blast shields 48, 52, 50, 54 with fasteners extending through elongated holes that permit the blast shields 48, 50, 52, 54 to move with respect to each other and the vehicle body 22 in the presence of a blast, thereby absorbing some of the energy of the blast. As also shown in FIG. 1, the center tunnel 216 is provided blast protection by an armor plate 218 that has an aluminum plate 220 bolted to its top surface.

Figure 15:
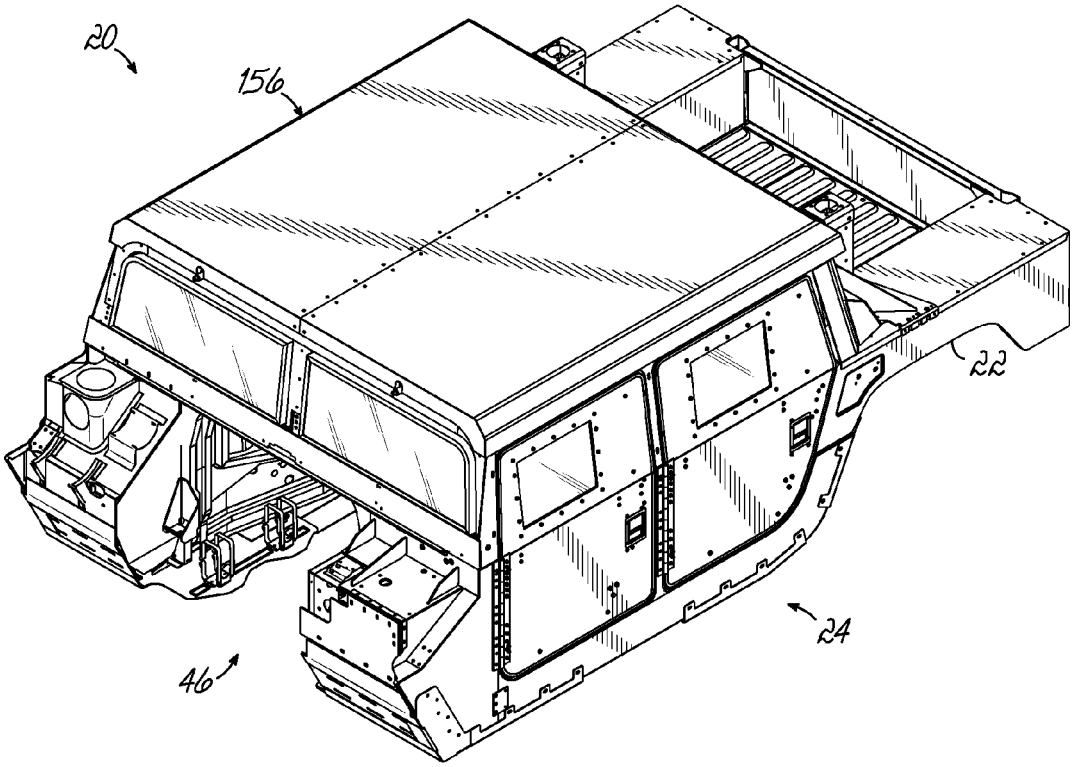
FIG. 15 is a perspective front view of the field retrofittable and reconfigurable lethal threat protection system of FIG. 1 assembled on a HMMWV.
Figure 16:
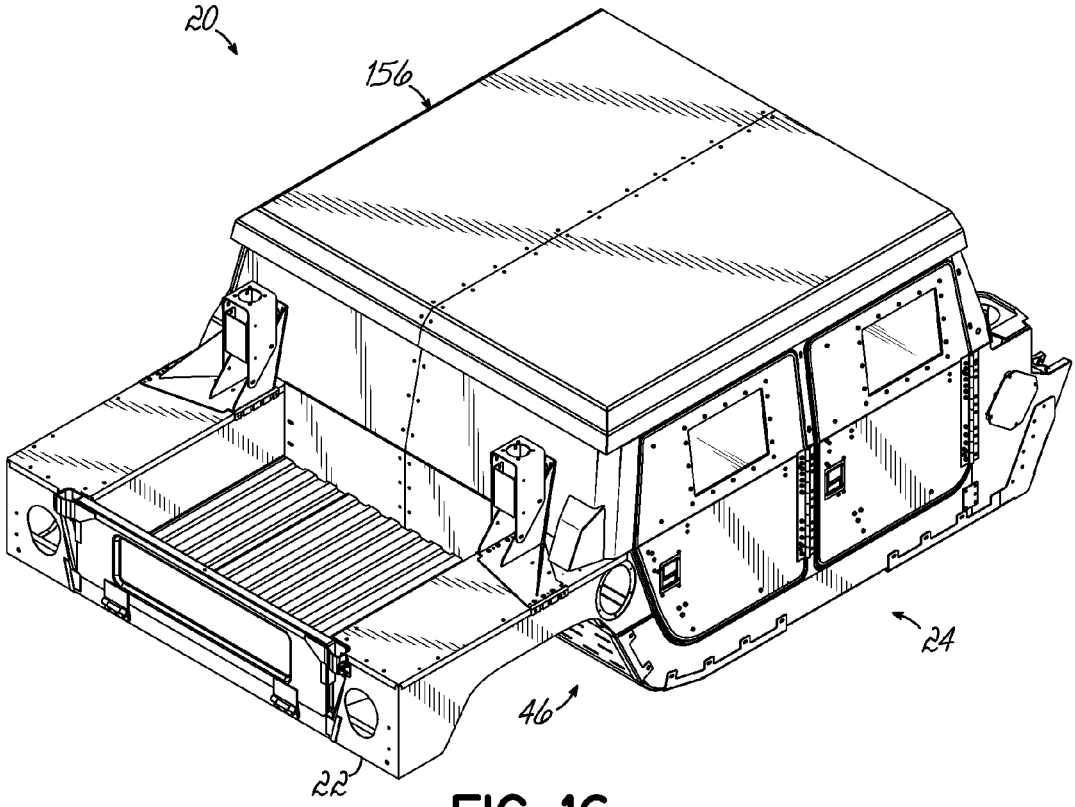
FIG. 16 is a perspective rear view of the field retrofittable and reconfigurable lethal threat protection system of FIG. 1 assembled on a HMMWV.

In use, a user purchases any or all of the components of the field retrofittable and reconfigurable lethal threat protection system 20 of FIG. 1. The armor pieces have manufactured holes that provide a template for drilling holes in the HMMWV 22 at locations that do not overlap OEM holes. Further, where armor pieces overlap or are otherwise connected together, some of the manufactured holes, for example, holes 146 of FIG. 2, are made oversize or elongated to facilitate locating the armor pieces to accept fasteners. Thus, the OEM parts can easily be reattached upon removal of the armor pieces, Any or all of the components of the field retrofittable and reconfigurable lethal threat protection system 20 of FIG. 1 can be attached to the HMMWV body 22 in the field using a simple set of portable, powered hand tools, for example, a drill, power wrench, etc, to provide a HMMWV with lethal threat protection as shown in FIGS. 15 and 16.

With the field retrofittable and reconfigurable lethal threat protection system 20, any combination of the components of the perimeter armor system 24 and/or the underbody blast protection system 46 can be readily installed in the field by the user. Further, if the perceived threat changes, the user can easily reconfigure the components of the lethal threat protection system 20. Alternatively, the user can choose to remove any or all of the components of the protection system 20 and reinstall the OEM windscreen, OEM doors and other OEM components using the OEM fasteners and OEM holes. The entire lethal threat protection system 20 can be removed with the exception of the tapping strips 88, 90 of FIG. 5, which are located inside respective B pillars 78, 80.

While the invention has been set forth by a description of the preferred embodiment in considerable detail, it is not intended to restrict or in any way limit the claims to such detail. Additional advantages and modifications will readily appear to those who are skilled in the art. For example, in the described embodiment, the HMMWV body 22 of FIG. 1 is a four door body; however, as will be appreciated, the field retrofittable and reconfigurable lethal treat protection system 20 can be readily adapted to a two door HMMWV body by simply eliminating the armored B pillars 34, 36 and armored rear doors 27, 29. in addition, even though lethal threat protection was described with respect to the A and B pillars, the concepts of the lethal threat protection system can be applied to C pillars as well. Further, the described embodiments relate to a HMMWV, however, as will be appreciated, in alternative embodiments, the field retrofittable and reconfigurable lethal threat protection system 20 can be designed for application to other types of vehicles.

The invention, therefore, in its broadest aspects, is not limited to the specific details shown and described. Consequently, departures may be made from the details described herein without departing from the spirit and scope of the claims which follow,

What is claimed is:

1. A field retrofittable and reconfigurable lethal threat protection system for protecting an occupant in a vehicle from a lethal threat, the vehicle having a rearward portion with a pair of rear wheel wells and a pair of rear foot wells, the occupant being positioned forward of the rear wheel wells and above the rear foot wells, said lethal threat protection system comprising:

a rear underbody blast shield adapted to cover an underbody area of the rearward portion of the vehicle, said blast shield adapted to be removably attached with fasteners to a lower most surface of one of the rear foot wells and to a lower most surface of a forward portion of a corresponding one of the rear wheel wells, said blast shield adapted to extend rearwardly adjacent the lower most surface of the one of the rear foot wells and upwardly and rearwardly adjacent the lower most surface of the forward portion of the one of the rear wheel wells, said blast shield thereby providing protection to the occupant from blast sources located below the one of the rear foot wells and the one of the rear wheel wells, and rear partition armor adapted to be removably connected with fasteners to the rear wheel wells, said rear partition armor extending in a first direction between the rear wheel wells and extending in a second direction upwardly from a location between the rear wheel wells, said rear partition armor thereby being adapted to be positioned behind the occupant.

2. The lethal threat protection system of claim 1 wherein said blast shield is adapted to extend rearwardly from the one of the rear foot wells adjacent a side surface of the one of the rear wheel wells.

3. The lethal threat protection system of claim 1 wherein said blast shield comprises:

an outer armor plate, an inner armor plate spaced inwardly from said outer plate, and structural tubes sandwiched between said inner and outer plates.

4. The lethal threat protection system of claim 3 wherein said structural tubes are welded to said inner and outer plates.

5. The lethal threat protection system of claim 3 wherein said structural tubes run transverse to a longitudinal extent of the vehicle.

6. The lethal threat protection system of claim 3 wherein said outer plate includes elongated holes adapted to have the fasteners extend therethrough to removably connect said blast shield to the vehicle, said elongated holes facilitating positioning of said blast shield and permitting said blast shield to move relative to the fasteners to thereby absorb a portion of the energy of a blast.

7. The lethal threat protection system of claim 3 wherein said inner plate, said outer plate, and said structural tubes are fabricated of steel, and further comprising an aluminum plate connected to said outer plate with fasteners.

8. The lethal threat protection system of claim 1 wherein said rear partition armor further comprises insulation extending over an area substantially equal to a forwardly directed area of said rear partition armor.

9. The lethal threat protection system of claim 1 wherein said rear partition armor comprises left and right partition armor plates joined by at least one gap strip.

10. The lethal threat protection system of claim 9 wherein said rear partition armor further comprises left and right seat backing armor, each of said left and right seat backing armor comprising an armor plate extending forwardly from a respective one of said left and right partition armor plates over a front side of a respective one of the left and right wheel wells and extending downwardly into a respective one of the left and right foot wells.

11. The lethal threat protection system of claim 10 wherein said rear partition armor further comprises left and right interior armor, each of said left and right interior armor comprising an armor plate extending from a respective one of said left and right seat backing armor plates rearwardly over an interior side of a respective one of the left and right wheel wells to a respective one of said left and right partition armor plates.

12. The lethal threat protection system of claim 9 wherein each of said left and right partition armor plates includes a pair of brackets mounted to an upper edge thereof adapted to mount a roof section to said left and right partition armor plates.

13. The lethal threat protection system of claim 9 wherein each of said left and right partition armor plates includes a bracket mounted to a rear side thereof adapted to mount each said partition armor plate to an outer portion of a respective one of the left and right wheel wells.

* * * * *